US010333208B2

(12) United States Patent
Ayatollahi et al.

(10) Patent No.: US 10,333,208 B2
(45) Date of Patent: Jun. 25, 2019

(54) ANTENNA DEVICE

(71) Applicants: Mina Ayatollahi, Waterloo (CA); Bruce Fuester, Northville, MI (US); Takeo Watanabe, Novi, MI (US)

(72) Inventors: Mina Ayatollahi, Waterloo (CA); Bruce Fuester, Northville, MI (US); Takeo Watanabe, Novi, MI (US)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/498,033

(22) Filed: Apr. 26, 2017

(65) Prior Publication Data

US 2017/0317409 A1 Nov. 2, 2017

Related U.S. Application Data

(60) Provisional application No. 62/330,547, filed on May 2, 2016.

(51) Int. Cl.
*H01Q 1/24* (2006.01)
*H01Q 1/32* (2006.01)
(Continued)

(52) U.S. Cl.
CPC ..... *H01Q 1/3275* (2013.01); *H01Q 9/42* (2013.01); *H01Q 21/28* (2013.01); *H01Q 1/241* (2013.01);
(Continued)

(58) Field of Classification Search
CPC ..... H01Q 1/36; H01Q 13/10; H01Q 13/106; H01Q 13/16
See application file for complete search history.

(56) References Cited

U.S. PATENT DOCUMENTS 6,366,243 B1 * 4/2002 Isohatala ..... H01Q 9/0407 343/700 MS
7,081,859 B2 7/2006 Miyoshi et al.
(Continued)

FOREIGN PATENT DOCUMENTS

JP 2005094437 A 4/2005
JP 2008022430 A 1/2008
(Continued)

OTHER PUBLICATIONS

International Preliminary Report on Patentability (IPRP) dated Nov. 6, 2018 (and English translation thereof) Issued in International application No. PCT/JP2017/016899.
(Continued)

*Primary Examiner* — Daniel Munoz
(74) *Attorney, Agent, or Firm* — Holtz, Holtz & Volek PC

(57) ABSTRACT

An antenna device includes a flat base body and a flat conductive body which is disposed on the base body and which has a polygonal shape such that a lower side opposed to a ground is shorter than an upper side. The conductive body includes a feeding point on the lower side and a slit which comprises an open end on the lower side in a vicinity of the feeding point. The slit includes a first slit portion which extends from the open end, a second slit portion which extends from an end of the first slit portion such that the second slit portion is turned to a perpendicular direction with respect to the first slit portion, and a third slit portion which extends from an end of the second slit portion such that the third slit portion is turned to a perpendicular direction with respect to the second slit portion.

7 Claims, 11 Drawing Sheets

(51) Int. Cl.

| | |
|---|---|
| ***H01Q 9/04*** | (2006.01) |
| ***H01Q 9/42*** | (2006.01) |
| ***H01Q 21/28*** | (2006.01) |
| *H01Q 1/42* | (2006.01) |

(52) U.S. Cl.
CPC ..... *H01Q 1/42* (2013.01); *H01Q 9/045* (2013.01); *H01Q 9/0414* (2013.01)

(56) References Cited

U.S. PATENT DOCUMENTS

| | | | | |
|---|---|---|---|---|
| 9,123,997 | B2 | 9/2015 | Ieda et al. | |
| 2005/0116873 | A1* | 6/2005 | Soler Castany | H01Q 1/38 343/795 |
| 2008/0198077 | A1* | 8/2008 | Duzdar | H01Q 1/3275 343/715 |
| 2012/0154253 | A1 | 6/2012 | Ieda et al. | |
| 2016/0181690 | A1* | 6/2016 | Cooper | H01Q 1/24 343/700 MS |

FOREIGN PATENT DOCUMENTS

| | | | |
|---|---|---|---|
| JP | 2008199371 | A | 8/2008 |
| JP | 2008228165 | A | 9/2008 |
| JP | 2010232865 | A | 10/2010 |
| JP | 2011250108 | A | 12/2011 |
| JP | 2012134739 | A | 7/2012 |

OTHER PUBLICATIONS

International Search Report (ISR) dated Jul. 25, 2017 (and English translation thereof) issued in International Application No. PCT/JP2017/016899.

* cited by examiner

ANTENNA DEVICE

BACKGROUND OF THE INVENTION

Field of the Invention

The present invention relates to an antenna device.

Description of Related Art

Recently, intelligent and broadband-connected automobiles have been drawing attention. 4G (Generation) LTE (Long Term Evolution) is the key technology to the realization of such connected automobiles. LTE offers speed, short waiting time and IP (Internet Protocol) connectivity for novel high-quality applications that support video-rich communication, navigation, information, entertainment and services based on the location information of a driver and passengers.

There are some factors that should be considered for integrating LTE into the automobile environment. The radio wave spectrum and antennas are some of the most important factors. LTE encompasses 40 bands or more, and it is necessary to simultaneously support at least 5 or 6 bands in many regions. Since automobiles can travel from one region to another, automobiles are likely to be required to support approximately 10 LTE bands.

In addition, LTE MIMO (Multiple-Input and Multiple-Output), which uses two antennas, will be expanded to more antennas in the future. An LTE antenna can be allocated in cooperation with a cellular modem inside an automobile or to an external assembly such as a shark fin antenna. In both scenarios, the antenna should be inconspicuous and small and also cover a huge band of 700 MHz to 2700 MHz. Such antennas are a challenge.

With regard to UWB (Ultra Wide Band) antennas, antenna devices that include a disk- or home base-shaped flat plate conductor have been known in the art (see JP 2005-94437A, JP 2008-199371A and JP 2010-232865A), which are intended to achieve broader band characteristics and reduced size.

However, there is a need for broader band characteristics and further reduced size of such antenna device. Specifically, there is a need for small and inconspicuous antennas that can cover the LTE bands in all regions in the world.

SUMMARY OF THE INVENTION

It is an object of the present invention to achieve broader band characteristics and reduced size of antenna devices.

In order to realize the above object, according to a first aspect of the present invention, there is provided an antenna device, including:

a flat base body; and a flat conductive body which is disposed on the base body and which has a polygonal shape such that a lower side opposed to a ground is shorter than an upper side;

wherein the conductive body includes:

a feeding point on the lower side; and a slit which comprises an open end on the lower side in a vicinity of the feeding point, wherein the slit includes:

a first slit portion which extends from the open end;

a second slit portion which extends from an end of the first slit portion such that the second slit portion is turned to a perpendicular direction with respect to the first slit portion; and a third slit portion which extends from an end of the second slit portion such that the third slit portion is turned to a perpendicular direction with respect to the second slit portion.

Preferably, in the antenna device, a distance between the feeding point and the open end of the slit is 2.0 mm.

Preferably, in the antenna device, the length of an outer periphery of the conductive body and an inner periphery of the slit is set to ¼ of a wavelength of a lowest operable frequency.

Preferably, in the antenna device, the first slit portion is bent 90 degrees each in two different directions.

Preferably, the antenna device further includes:

an antenna cover having a shape of a shark fin;

an antenna base connected to the antenna cover; and a base board which is disposed on the antenna base and which comprises a grounded portion, wherein the base body and the conductive body are mounted on the base board.

Preferably, the antenna device further includes:

a case of a communication unit; and a base board which is disposed in the case and comprises a grounded portion, wherein the base body and the conductive body are mounted on the base board.

Preferably, in the antenna device, the base body and the conductive body are folded according to an inner shape of the case.

BRIEF DESCRIPTION OF THE DRAWINGS

The present invention will become more fully understood from the detailed description given hereinbelow and the appended drawings which are not intended as a definition of the limits of the present invention, and wherein.

PREFERRED EMBODIMENT OF THE INVENTION

Hereinafter, an embodiment and variations of the present invention will be described based on the drawings. However, the present invention is not limited to the illustrated examples.

Embodiment

Figure 1:
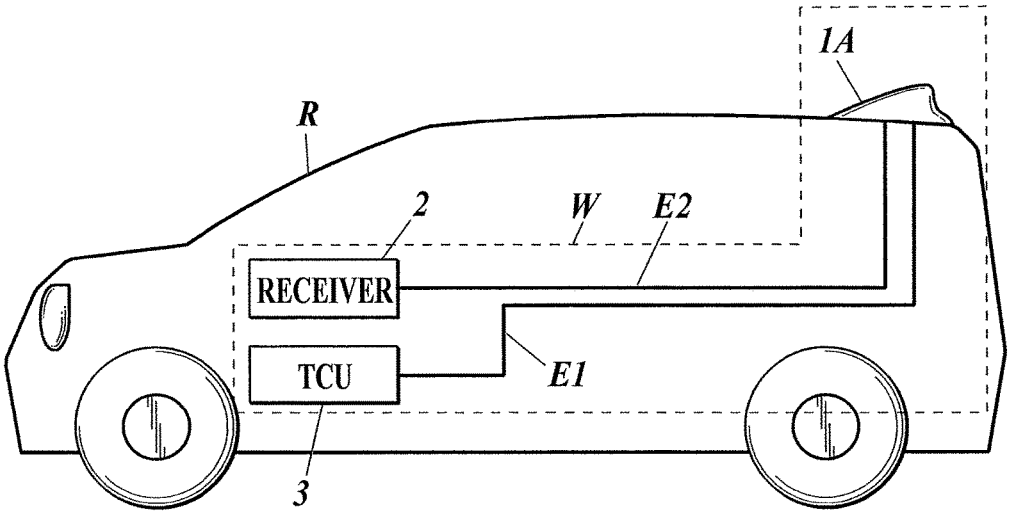
FIG. 1 is a see-through view of an on-board wireless communication system according to an embodiment of the present invention.

An embodiment of the present invention will be described referring to FIG. 1 to FIG. 11. First, the configuration of a wireless communication system W according to an embodiment will be described referring to FIG. 1. FIG. 1 is a see-through view of a wireless communication system W in a vehicle R.

As illustrated in FIG. 1, the wireless communication system W, which performs wireless communication in telematics services, is installed in the vehicle R which is an automobile. Telematics services are a general term for a variety of services that use mobile communication (wireless communication) for achieving safety and security functions of automobiles and improving convenience by information distribution. The wireless communication system W is configured to perform communication by wireless communication methods of LTE, SDARS (satellite digital audio radio service) for satellite radios and GPS (global positioning system) for positioning. However, the communication methods are not limited thereto, and the wireless communication system W may be configured to perform communication by other wireless communication methods.

The wireless communication system W includes an antenna device 1A, a receiver 2 and a TCU (Telematics Control Unit) 3. The antenna device 1A has the shape of a shark fin and is attached to a fixing opening (not shown) in a mounting face of the roof of the vehicle R along a streamline in the front-rear direction of the vehicle R. The antenna device 1A, which includes antennas for LTE, SDARS and GPS, is connected to the TCU 3 and the receiver 2 via cables E1, E2.

The receiver 2, which is included in an on-board equipment, serves as a SDARS and GPS receiver. The TCU 3, which includes at least an antenna for LTE, controls the communication through LTE and the like. The TCU 3 is connected to the antenna device 1A via the cable E1. LTE antennas are provided to two systems of the antenna device 1A and the TCU 3 in order to secure communication with an external correspondent even when one of the systems is inoperable in an emergency of the vehicle R or the crew.

Figure 2:
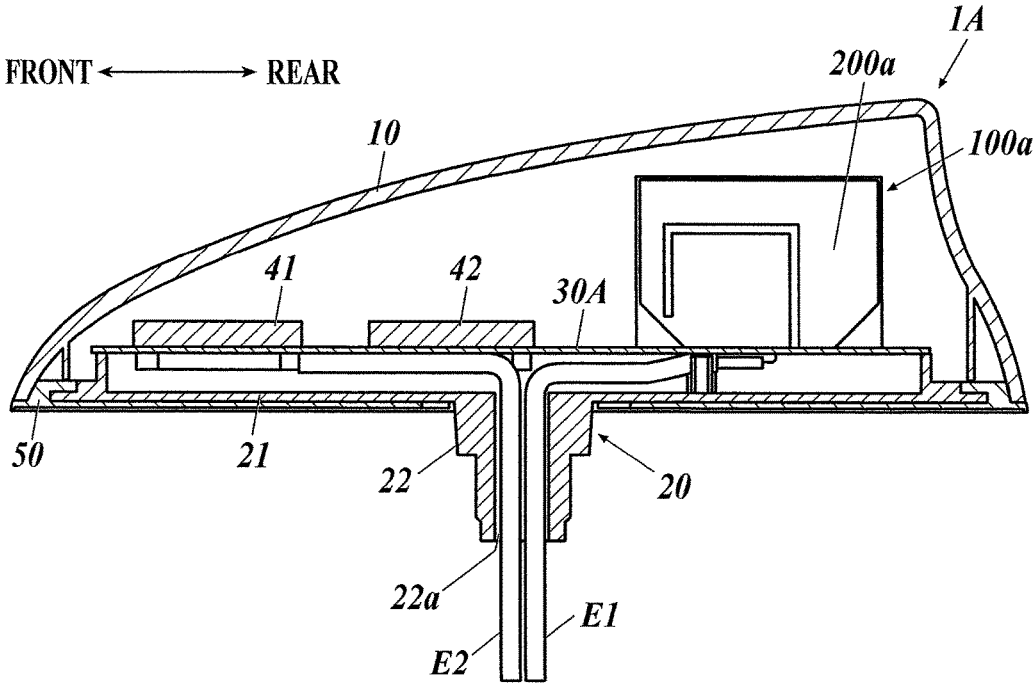
FIG. 2 is a cross sectional view of a first antenna device, illustrating the internal configuration thereof.

The internal configuration of the antenna device 1A will be described referring to FIG. 2. FIG. 2 is a cross sectional view of the antenna device 1A, illustrating the internal configuration thereof.

As illustrated in FIG. 2, the antenna device 1A includes an antenna cover 10, an antenna base 20, a base board 30A, a planar antenna 100*a*, patch antennas 41, 42 and a gasket 50.

The antenna cover 10 expands in width toward the rear side and protrudes rearward in a streamline shape along the longitudinal direction, which is thus formed in a low-profile shark fin shape so as not to disfigure the vehicle. The antenna cover 10 is made of a synthetic resin that is permeable to radio wave and electrically insulative, such as acrylic resin.

The antenna base 20, which includes a base member 21 and a protrusion 22, is constituted by an integrally formed metal die-cast such as aluminum. The base member 21 has an approximately flat shape that fits the bottom opening of the antenna cover 10, and the base board 30A is mounted on the upper surface. The protrusion 22 is configured to be inserted into the fixing opening in the roof of the vehicle R so as to fix the antenna device 1A. The protrusion 22 has male screw threads as a bolt and a groove 22*a* along the axis thereof. The cable E1, which is electrically connected to the TCU 3 installed in the vehicle R, and the cable E2, which is electrically connected to the receiver 2 installed in the vehicle R, are inserted in the groove 22*a*. The cable E1 is constituted by a coaxial cable or the like for the planar antenna 100*a*. The cable E2 is constituted by a coaxial cable or the like for the patch antennas 41, 42.

The protrusion 22 is inserted in the fixing opening of the vehicle R and fastened with a fixing member (not shown) such as a nut from the inside of the vehicle R so that the mounting face of the roof of the vehicle R is clamped. The antenna device 1A is thus fixedly mounted on the mounting face of the vehicle R. Further, the base member 21 is electrically connected to the mounting face and is thereby grounded via the body of the vehicle R. The antenna cover 10 is screwed to the antenna base 20 at female screws of bosses formed on the inner surface from the back side of the base member 21.

The base board 30A includes a tuning circuit for selectively receiving radio wave at a specific frequency and an amplifier circuit, which is constituted by a circuit board such as a PCB (printed circuit board) fixedly mounted on the upper face of the base member 21, for example, by means of screws. The base board 30A, which serves as a base board of the patch antennas 41, 42 and the planar antenna 100*a*, suitably includes a grounded portion.

The planar antenna 100*a*, which is an antenna for ETC composed of a planar antenna portion 200*a*, is fixedly disposed on the base board 30A in a standing manner by means of a support (not shown) such that the thickness direction of the plane is perpendicular to the front-rear direction of the antenna device 1A. The conductive body 220*a* of the planar antenna portion 200*a*, which will described later, is exposed to the front side in the figure. The configuration and antenna characteristics of the planar antenna 100*a* will be described in detail later.

For example, the planar antenna 100*a* is soldered to the inner conductor of the coaxial cable E1 at a feeding point, and the ground of the planar antenna 100*a* (base board 30A) is connected to the outer conductor of the cable E1. The feeding point of the planar antenna 100*a* may be included in the feeding line of the patch antennas 41, 42 in the base board 30A.

The patch antenna 41 is a patch antenna for SDARS for receiving radio wave from SDARS satellites, which is fixedly mounted on the base board 30A. The patch antenna 42 is a patch antenna for GPS for receiving radio wave from GPS satellites, which is fixedly mounted on the base board 30A.

The gasket 50 is constituted by an elastic body that is impermeable to water and resistant to chemicals and is made of a petroleum rubber or the like such as EPDM (ethylene propylene diene monomer). The gasket 50 is disposed along the periphery of the base member 21 and is nipped between the base member 21 and the roof of the vehicle R when the protrusion 22 is inserted in the fixing opening of the vehicle R and fastened by means of a fixing member. The gasket 50 can thereby maintain the water tightness of the insides of the antenna cover 10 and the vehicle R.

Figure 3:
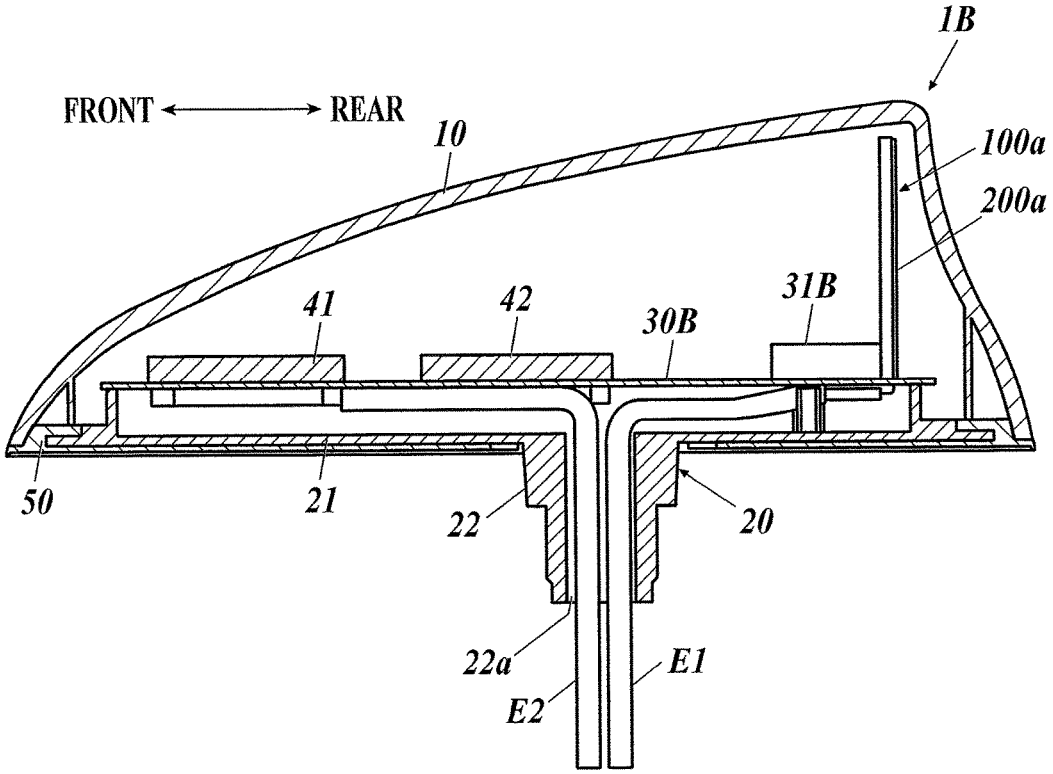
FIG. 3 is a cross sectional view of a second antenna device, illustrating the internal configuration thereof.

FIG. 3 is a cross sectional view of an antenna device 1B, illustrating the internal configuration thereof. The antenna device 1A may be replaced with the antenna device 1B of FIG. 3. The antenna device 1B is configured such that it includes a base board 30B instead of the base board 30A of the antenna device 1A, and the planar antenna 100*a* is mounted in a different direction.

The base board 30B has the same configuration as the base board 30A except that it has a different mounting area for the planar antenna 100*a*. In the antenna device 1B, the planar antenna 100*a* is fixedly disposed on a base board 30B in a standing manner by means of a support 31B mounted on the base board 30B such that the thickness direction of the plane is parallel to the front-rear direction of the antenna device 1B. The conductive body 220*a* of the planar antenna portion 200*a* is exposed to the far side in the figure.

Since the antenna devices 1A, 1B as shark fin modules include antennas for SDARS, GPS and the like as well as for ETC, it is important to carefully design them so that such different antennas are sufficiently isolated from each other.

Figure 4A:
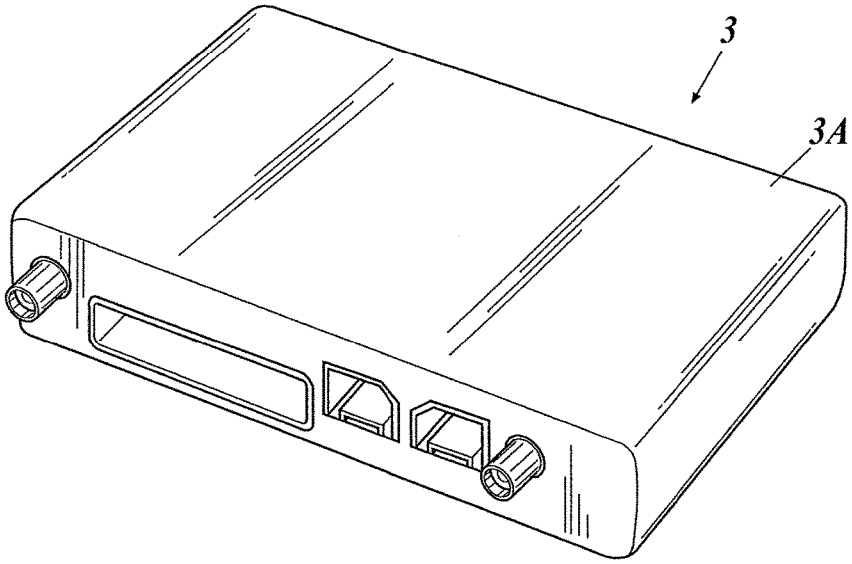
FIG. 4A is an outer appearance view of a TCU.
Figure 4B:
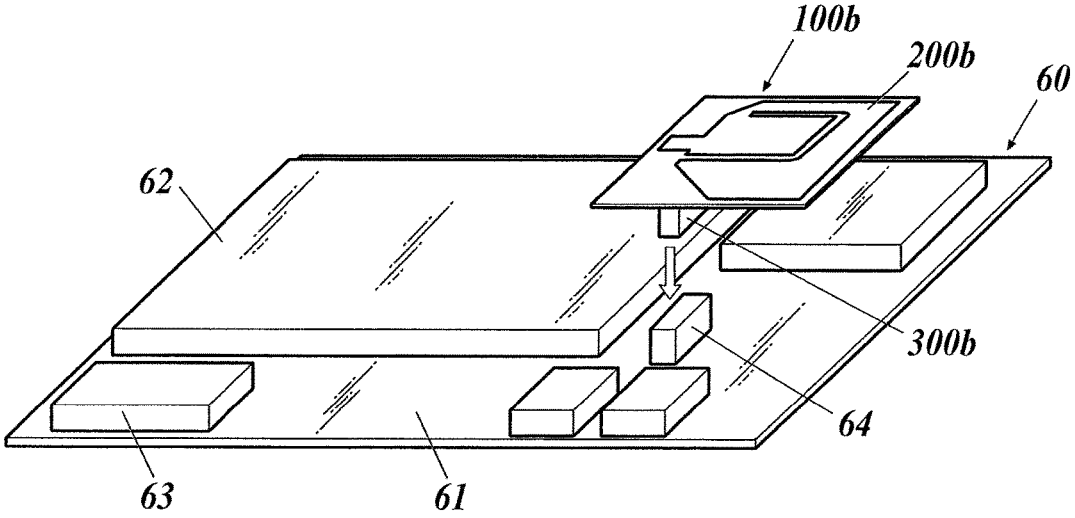
FIG. 4B is a schematic view of the TCU, illustrating the internal configuration thereof.

Next, the configuration of the TCU 3 will be described referring to FIG. 4A and FIG. 4B. FIG. 4A is an outer appearance view of the TCU 3. FIG. 4B is a schematic view of the TCU 3, illustrating the internal configuration thereof.

As illustrated in FIG. 4A, the TCU 3 includes a resin case 3A having an approximately rectangular box shape. As illustrated in FIG. 4B, the TCU 3 includes a base board 60 and a planar antenna 100*b* inside the case 3A. The base board 60 includes a main base board 61 of a PCB and also includes a communication circuit 62 for the planar antenna 100*b*, other circuit 63 and a connector 64 which are mounted on the main base board 61. The connector 64 is provided to attach the planar antenna 100*b*.

The planar antenna 100*b* includes a planar antenna portion 200*b* and a connector 300*b*. The planar antenna portion 200*b* is the same antenna as the planar antenna portion 200*a*, which is electrically connected to the conductive body of the connector 300*b* at a feeding point. The connector 300*b* is electrically and physically connected to the connector 64. The connector 300*b* of the planar antenna 100*b* is connected to the connector 64 such that the plane of the planar antenna portion 200*b* is parallel to the plane of the main base board 61.

Figure 5:
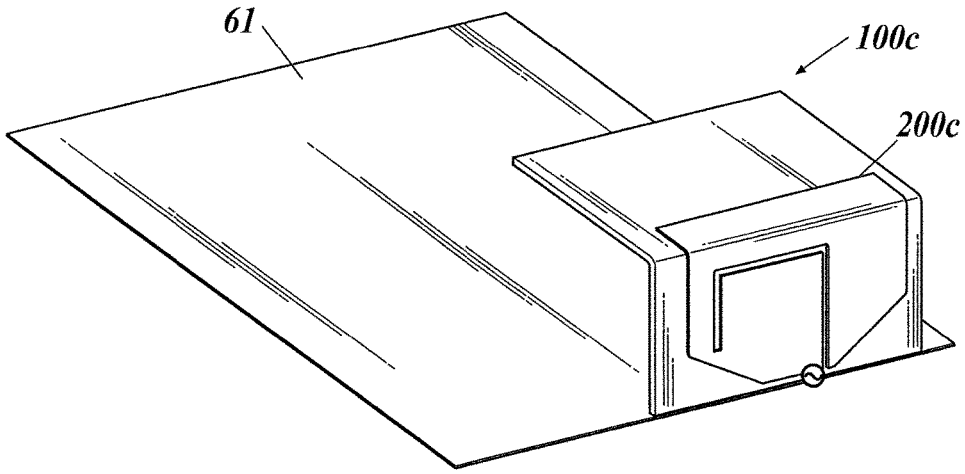
FIG. 5 is a perspective view of a third planar antenna.

FIG. 5 is a perspective view of a planar antenna 100*c*. The TCU 3 may include a planar antenna 100*c* of FIG. 5 instead of the planar antenna 100*b*. The planar antenna 100*c* includes a planar antenna portion 200*c*. The planar antenna portion 200*c* has the same shape as the planar antenna portion 200*a* except that it is folded to 90 degrees. Further, the planar antenna portion 200*c* is fixedly disposed at an end of the main base board 61 in a standing manner by means of a support (not shown). Since the planar antenna portion 200*c* is folded, the planar antenna 100*c* is further reduced in size and housed in the case 3A.

Figure 6:
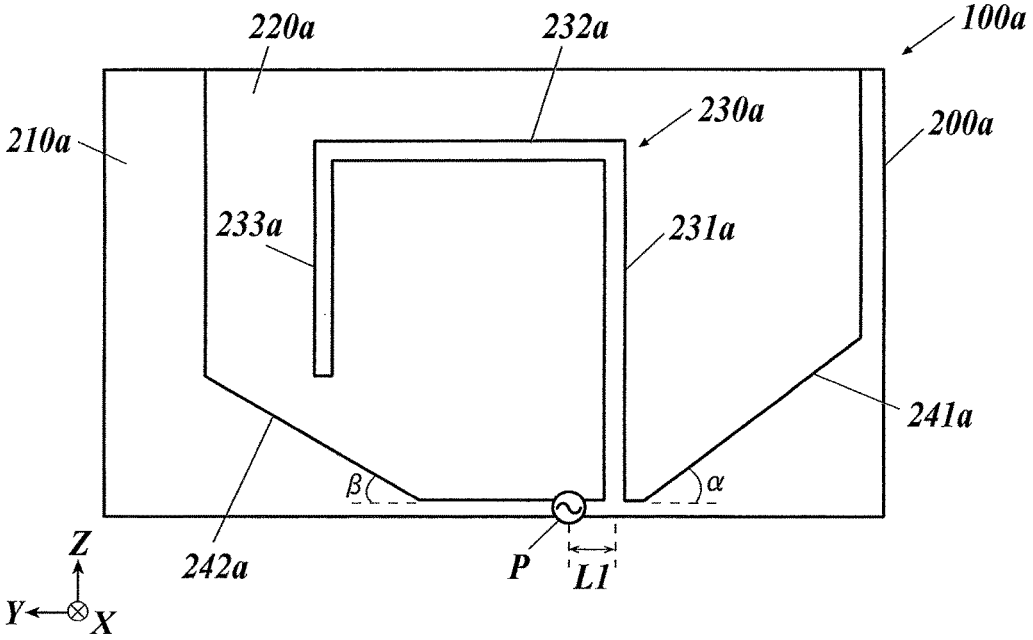
FIG. 6 is a plan view of a first planar antenna.

Next, the configuration of the planar antenna portion 200*a* of the planar antenna 100*a* will be described referring to FIG. 6. FIG. 6 is a plan view of the planar antenna 100*a*.

As illustrated in FIG. 6, the planar antenna portion 200*a* is configured such that the conductive body 220*a* is formed on one face of an antenna base board 210*a*. For example, the antenna base board 210*a* is constituted by an insulating base board of FR4 (Flame Retardant Type 4) or the like. The X, Y and Z axes are defined as illustrated in FIG. 6. For example, the antenna base board 210*a* has a dimension of Y×Z=32 mm×25 mm.

The conductive body 220*a* is constituted by a flat conductor made of a copper foil, which has a trapezoidal (polygonal) shape such that the lower side is shorter than the upper side. The conductive body 220*a* includes a slit 230*a* which is a cutout in the conductor, and tapered portions 241*a*, 242*a*. On the lower side of the conductive body 220*a*, a feeding point P is provided which is electrically connected to the inner conductor of the cable E2. The slit 230*a* has a narrow open end near the right side of the feeding point P.

The slit 230*a* is composed of straight slit portions 231*a*, 232*a*, 233*a*. The straight slit portion 231*a* has the shape of a straight strip and extends in the +Z direction from the open end near the right side of the feeding point P. The straight slit portion 232*a* has the shape of a straight strip and extends in the +Y direction from the end of the straight slit portion 231*a*. The straight slit portion 233*a* has the shape of a straight strip and extends in the −Z direction from the end of the straight slit portion 232*a*.

The slit 230*a* is provided to change the electric current distribution so as to cause resonance within the LTE low frequency band of 748 MHz to 960 MHz. The length and width of the slit 230*a* are selected according to the resonant frequency. The length of the straight slit portions 231*a*, 232*a*, 233*a* defines the resonant frequency in the LTE low frequency band. The current path length is equal to ¼ of the wavelength of the lowest operating frequency, which includes the total length (inner periphery) of the slit 230*a* and the outer periphery of the conductive body 220*a*. The slit 230*a* causes further resonation to increase the bandwidth of the antenna.

To achieve the better impedance matching and bandwidth, the slit 230*a* should start from a point that is located to the right of the feeding point P on the Y axis as close as possible to the feeding point. In the design of the embodiment, the length is L1=2.0 mm. The position of the feeding point P is determined by firstly selecting the center of the lower end of the conductive body and then optimizing it so that the possible widest bandwidth is achieved within the low frequency band of 748 MHz to 960 MHz. The planar antenna portion 200*a* is coupled over the two parallel straight slit portions 231*a*, 233*a*, which particularly increases the bandwidth.

The tapered portion 241*a* is located at the lower right of the conductive body 220*a*. The angle between the tapered portion 241*a* and the lower side of the conductive body 220*a* is represented as angle α. The tapered portion 242*a* is located at the lower left of the conductive body 220*a*. The angle between the tapered portion 242*a* and the lower side of the conductive body 220*a* is represented as angle β. Since the tapered portions 241*a*, 242*a* substantially increase the impedance bandwidth, the angles α, β are optimized so as to be asymmetrical in the Y direction. The impedance bandwidth of the planar antenna portion 200*a* is at least 6 times greater than that of a planar antenna with a rectangular conductive body. As in the planar antenna portion 200*a*, the angle α of the tapered portion 241*a* may be larger than the angle β of the tapered portion 242*a*.

The planar antenna 100*a* is a monopole antenna. Accordingly, the planar antenna 100*a* can be analyzed by using a transmission-line model. Since the height of the conductive body 220*a* is continuously increased with respect to the grounded portion of the base board 30A, the inclined edge can be modeled as a tapered line in this case. Accordingly, the tapered portions 241*a*, 242*a* enable designing the continuous variable characteristic impedance to increase the number of resonances so as to achieve broadband matching.

By increasing the angles α, β, the bandwidth and the highest wavelength are increased. The left and right angles α, β each produce the same effect.

As described above, the planar antenna 100*a*, 100*b*, 100*c* are based on an ultra wide band monopole concept. While the planar antennas 100*a*, 100*b*, 100*c* are intended for use as main LTE antenna, they are not limited thereto and may also be used as diversity antennas.

Figure 7:
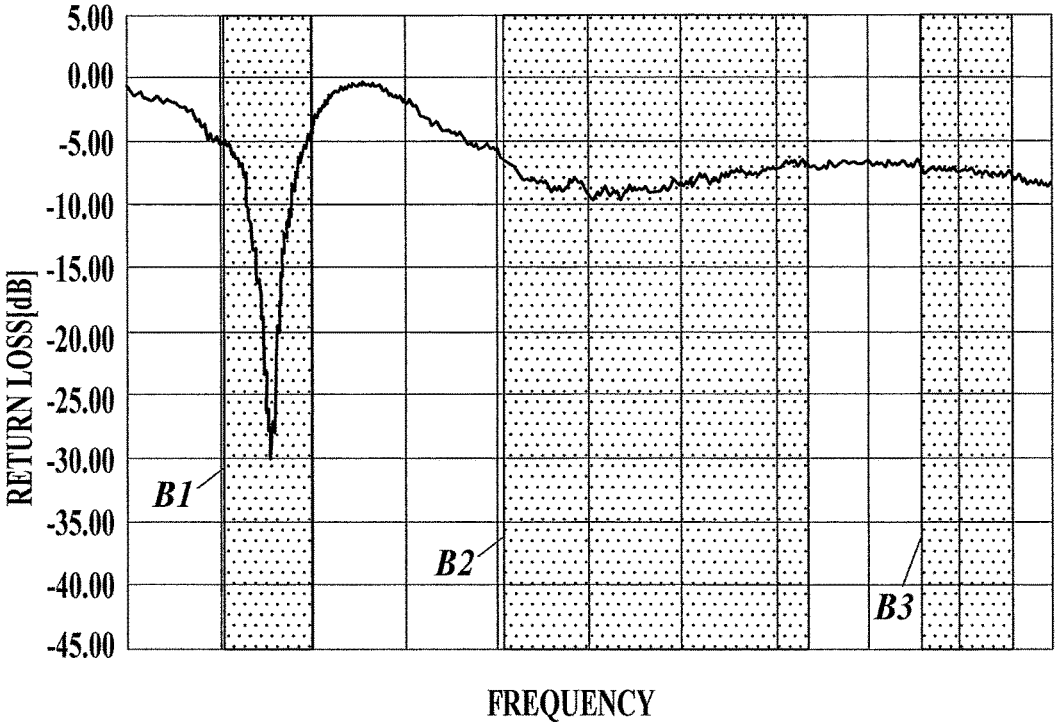
FIG. 7 illustrates the return loss of the first planar antenna with respect to frequency.
Figure 8:
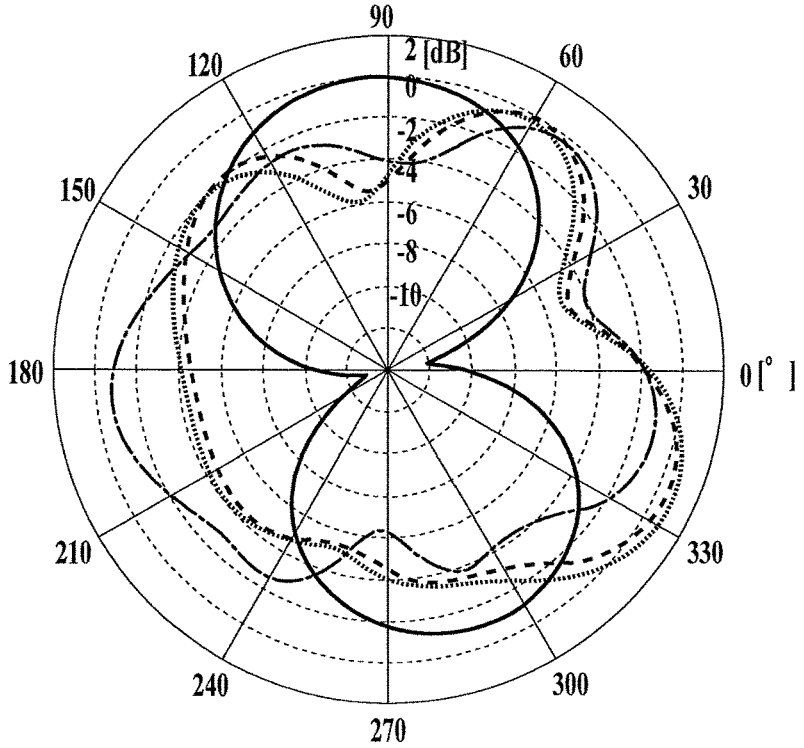
FIG. 8 illustrates the gain of the first planar antenna in the far-field horizontal plane.
Figure 9:
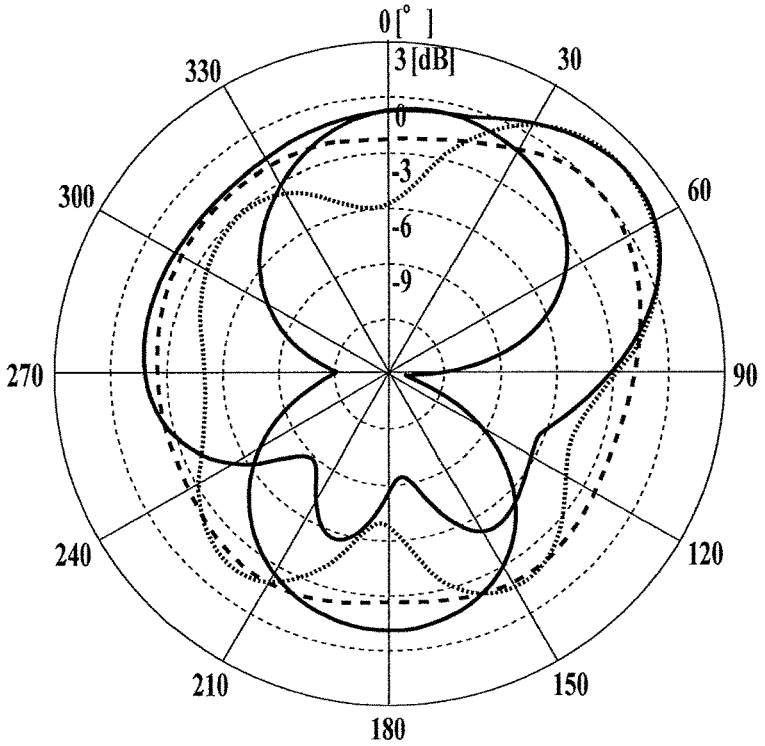
FIG. 9 illustrates the gain of the first planar antenna in the far-field vertical plane.
Figure 10:
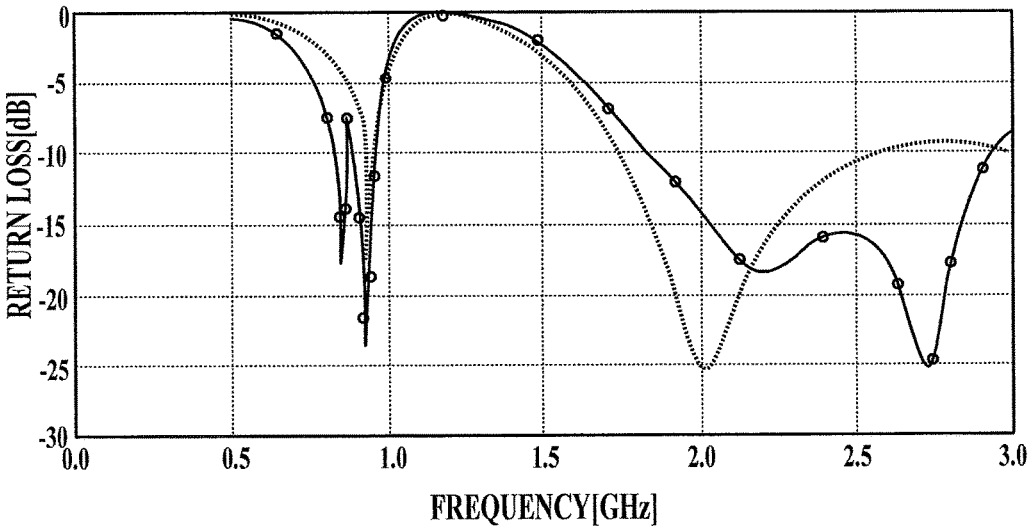
FIG. 10 illustrates the return loss of the first planar antenna and a planar antenna with a feeding point away from a slit with respect to frequency.
Figure 11:
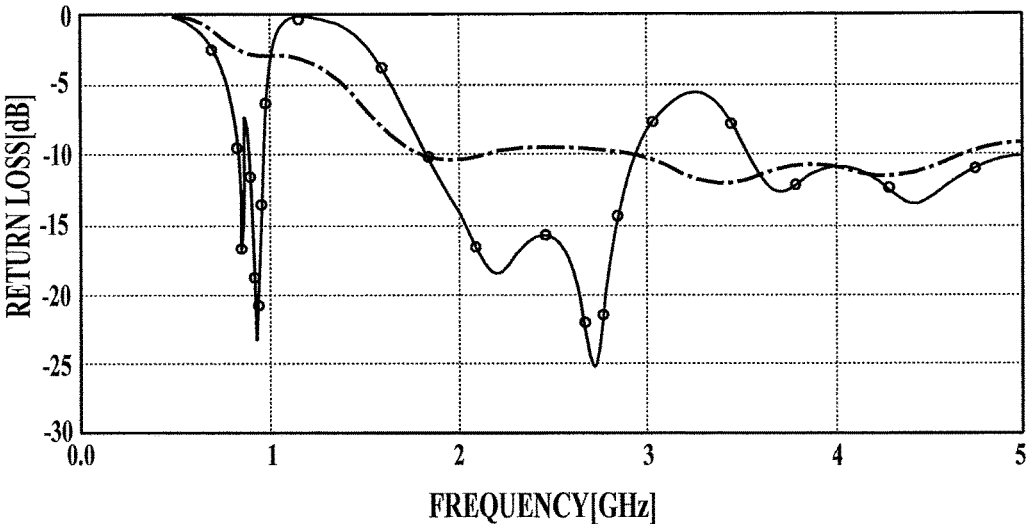
FIG. 11 illustrates the return loss of the first planner antenna and a planar antenna with no slit with respect to frequency.

Next, the antenna characteristics of the planar antenna 100*a* will be described referring to FIG. 7 to FIG. 11. The planar antennas 100*b*, 100*c* have the same antenna characteristics as the planar antenna 100*a*. FIG. 7 illustrates the return loss of the planar antenna 100*a* with respect to frequency. FIG. 8 illustrates the gain of the planar antenna 100*a* in the far-field horizontal plane. FIG. 9 illustrates the gain of the planar antenna 100*a* in the far-field vertical plane. FIG. 10 illustrates the return loss of the planar antenna 100*a* and a planar antenna with a feeding point away from the slit with respect to frequency. FIG. 11 illustrates the return loss of the planar antenna 100*a* and a planar antenna with no slit with respect to frequency.

To measure the antenna characteristics, the planar antenna 100*a* was powered by using a coaxial cable and a FAKRA connector and was disposed at an end of the ground board. In this condition, the return loss (reflection coefficient S11) of the planar antenna 100*a*, which is one of the antenna characteristics, was measured. The ground board had the same size as the base board 60 of the TCU 3.

Regarding the return loss of the planar antenna 100*a* with respect to frequency, the measurement result as illustrated in FIG. 7 was obtained in the frequency range including frequency bands B1, B2, B3. The frequency bands B1, B2, B3 correspond respectively to LTE frequency bands of 748 MHz to 960 MHz, 1450 MHz to 2175 MHz and 2490 MHz to 2690 MHz.

As shown in FIG. 7, the antenna exhibited a good return loss of −5 dB or less in the frequency bands B1, B2, B3. In particular, the antenna exhibited a better resonated return loss in the frequency band B1.

Further, the gain of the planar antenna 100*a* in the far-field horizontal plane (X-Y plane in FIG. 2) was simulated, and the result as shown in FIG. 8 was obtained. In FIG. 8, the solid line is the gain at a frequency of 0.75 GHz, the dotted line is the gain at a frequency of 1.91 GHz, the dashed line is the gain at a frequency of 2.1 GHz, and the dash-dot line is the gain at a frequency of 2.54 GHz.

Similarly, the gain of the planar antenna 100*a* in the far-field vertical plane (Y-Z plane in FIG. 2) was simulated, and the result as shown in FIG. 9 was obtained. The lines in FIG. 9 represent the same gains as in FIG. 8.

Next, as illustrated in FIG. 10, the return losses of the planar antenna 100*a* and a first planar antenna for comparison with a feeding point away from the slit was measured with respect to frequency. In FIG. 10, the solid line is the return loss of the planar antenna 100*a*, and the dotted line is the return loss of the first antenna for comparison.

The planar antenna 100*a* was configured such that the distance from the open end of the slit 230*a* to the feeding point P was 2.0 mm, which was the optimal length. In contrast, the first antenna for comparison was configured such that the distance from the open end of the slit to the feeding point was 7 cm. The first antenna for comparison exhibited much reduced low frequency bandwidth compared to the planar antenna 100*a*. The bandwidth with a return loss of −10 dB was 140 MHz in the planar antenna 100*a* but was reduced to 20 MHz in the first antenna for comparison.

As illustrated in FIG. 11, the return losses of the planar antenna 100*a* with the slit 230*a* and a second planar antenna for comparison with no slit was measured with respect to frequency. In FIG. 11, the solid line is the return loss of the planar antenna 100*a*, and the dash-dot line is the return loss of the second antenna for comparison.

The second antenna for comparison exhibited no resonated return loss at low frequency, although it is required in the frequency bands of LTE. That is, the slit 230*a* causes resonance at a low frequency of approximately from 750 MHz to 960 MHz.

As described above, the planar antenna 100*a* according to the embodiment includes the flat antenna base board 210*a* and the flat conductive body 220*a* that is disposed on the antenna base board 210*a* and has a trapezoidal shape such that the lower side opposed to the grounded portion is shorter than the upper side. The feeding point P is provided on the lower side of the conductive body 220*a*, and the conductive body 220*a* has the slit 230*a* with the open end in the vicinity of the feeding point P on the lower side. The slit 230*a* includes the straight slit portion 231*a* that extends from the open end, the straight slit portion 232*a* that extends from the end of the straight slit portion 231*a* such that the straight slit portion 232*a* is turned anticlockwise to the perpendicular direction with respect to the straight slit portion 231*a*, and the straight slit portion 233*a* that extends from the end of the straight slit portion 232*a* such that the straight slit portion 233*a* is turned anticlockwise to the perpendicular direction with respect to the straight slit portion 232*a*.

This enables expanding the band characteristics and reducing the size of the planar antenna 100*a* of the antenna devices 1A, 1B. Further, the tapered portions 241*a*, 242*a* of the conductive body 220*a* enable increasing the impedance bandwidth, which facilitate impedance matching. Further, the coupling of the parallel straight slit portions 232*a*, 233*a* enables increasing the bandwidth.

The planar antenna 100*a* enables providing a small and inconspicuous antenna that covers all LTE bands in all regions in the world. While different antennas are typically required in different regions, the planar antenna 100*a* for LTE can be used in different regions in the world without changing the configuration thereof.

The distance between the feeding point P and the open end of the slit 230*a* is 2.0 mm. This enables increasing the low frequency bandwidth.

The length of the outer periphery of the conductive body 220*a* and the inner periphery of the slit 230*a* is equal to ¼ of the wavelength of the lowest operational frequency. This enables achieving better impedance matching and better bandwidth.

The antenna devices 1A, 1B each include the antenna cover 10 having the shape of a shark fin, the antenna base 20 connected to the antenna cover 10, and the base board 30A, 30B which includes the grounded portion and which is disposed on the antenna base 20. The planar antenna 100*a* is mounted on the base board 30A, 30B. Therefore, the planar antenna 100*a* is applicable to shark fin antennas as external antennas.

The TCU 3 as the antenna device includes the case 3A of the TCU 3 and the base board 60 which includes the grounded portion and which is disposed in the case 3A. The planar antennas 100*b*, 100*c* are mounted on the base board 60. Therefore, the planar antennas 100*b*, 100*c* are applicable to communication units for telematics as internal antennas.

The planar antenna 100*c* is folded according to the inner shape of the case 3A. This facilitates housing the planar antenna 100*c* in the case 3A without changing the antenna characteristics.

Variations

Figure 12A:
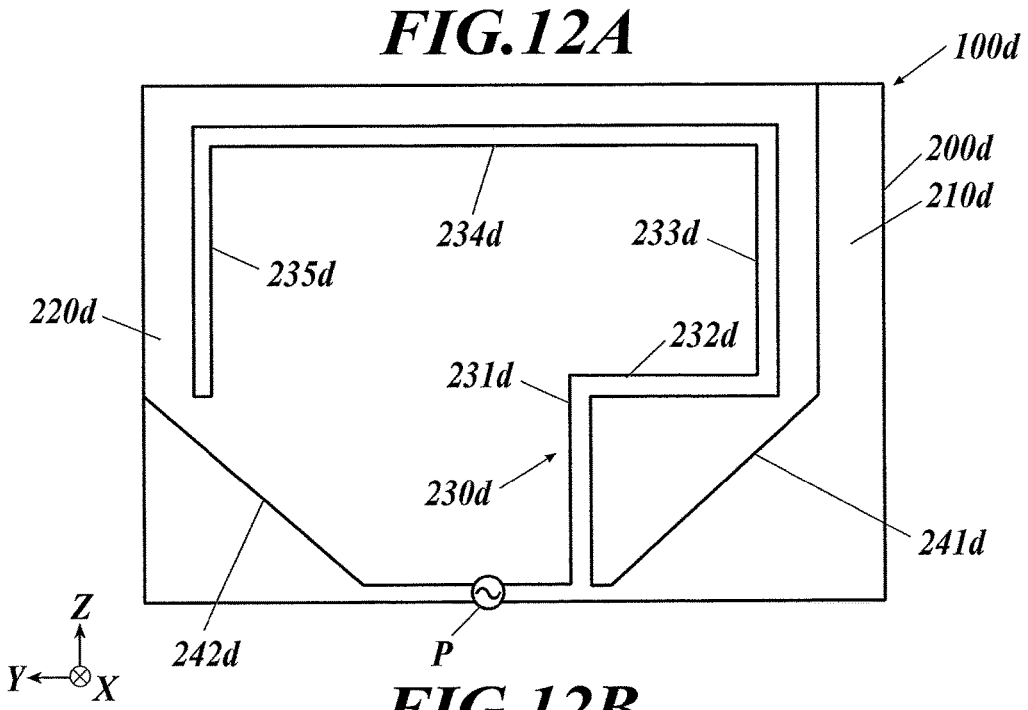
FIG. 12A is a plan view of a fourth planar antenna.
Figure 12B:
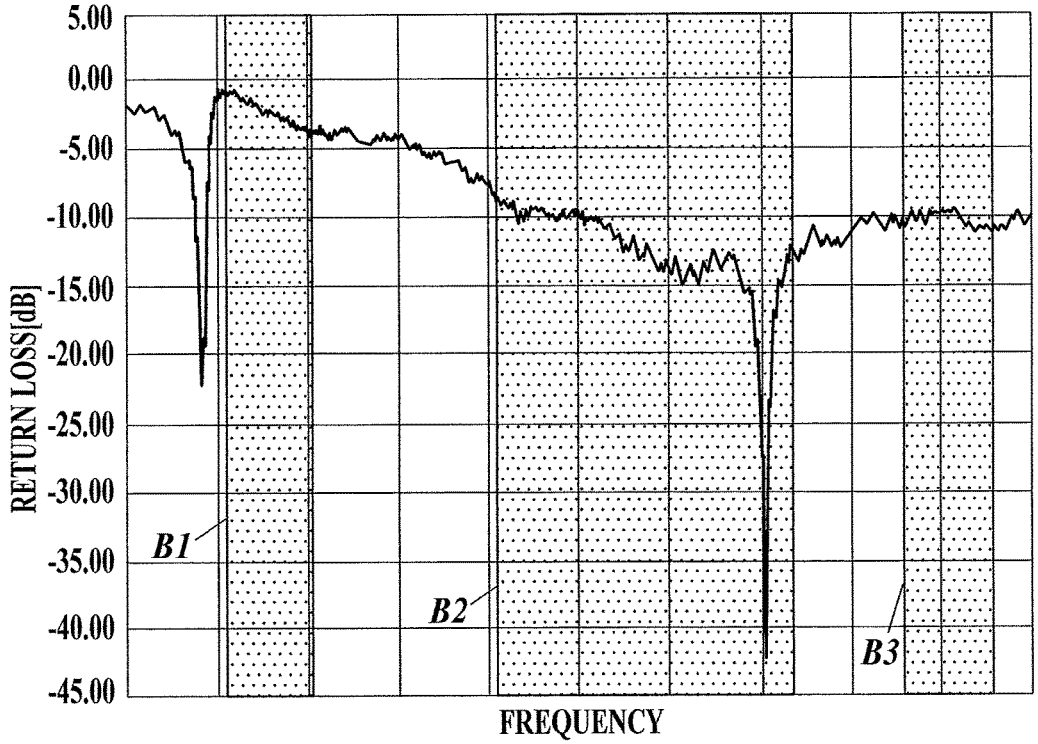
FIG. 12B illustrates the return loss of the fourth planar antenna with respect to frequency.

Variations of the planar antenna 100*a* according to the embodiment will be described referring to FIG. 12A to FIG. 15. First, a planar antenna 100*d* of a first variation will be described referring to FIG. 12A and FIG. 12B. FIG. 12A is a plan view of the planar antenna 100*d*. FIG. 12B illustrates the return loss of the planar antenna 100*d* with respect to frequency.

As illustrated in FIG. 12, the planar antenna 100*d* includes a planar antenna portion 200*d*. The planar antenna portion 200*d* is configured such that a conductive body 220*d* is formed on one face of an antenna base board 210*d*. The antenna base board 210*d* and the conductive body 220*d* are made of the same materials as those of the antenna base board 210*a* and the conductive body 220*a* of the embodiment.

The conductive body 220*d* includes a slit 230*d* and tapered portions 241*d*, 242*d*. On the lower end (lower side) of the conductive body 220*d*, a feeding point P is provided. The slit 230*d* is composed of straight slit portions 231*d*, 232*d*, 233*d*, 234*d* and 235*d*.

The straight slit portion 231*d* has the shape of a straight strip and extends in the +Z direction from an open end near the right side of the feeding point P. The straight slit portion 232*d* has the shape of a straight strip and extends in the −Y direction from the end of the straight slit portion 231*d*. The straight slit portion 233*d* has the shape of a straight strip and extends in the +Z direction from the end of the straight slit portion 232*d*. The straight slit portions 231*d*, 232*d*, 233*d* correspond to a single slit portion that is bent 90 degrees twice. The straight slit portion 234*d* has the shape of a straight strip and extends in the +Y direction from the end of the straight slit portion 233*d*. The straight slit portion 235*d* has the shape of a straight strip and extends in the −Z direction from the end of the straight slit portion 234*d*.

That is, the slit 230*d* has the same shape as the slit 230*a* of the above-described embodiment except that the portion corresponding to the straight slit portion 231*a* is bent 90 degrees. Regarding the return loss of the planar antenna 100*d* with respect to frequency, the measurement result as shown in FIG. 123 was obtained in the frequency range including the frequency bands B1, B2, B3. In FIG. 12B, the antenna exhibited good return loss in the frequency band B1 and also good return loss of −5 dB or less in the frequency bands B2, B3. In particular, the antenna exhibited better resonated return loss in the frequency band B2.

In the first variation, the slit portion (straight slit portions 231*d*, 232*d*, 233*d*) extending from the open end is bent clockwise or anticlockwise to 90 degrees each. This configuration also enables expanding the band characteristics and reducing the size of the planar antenna 100*d*.

Figure 13A:
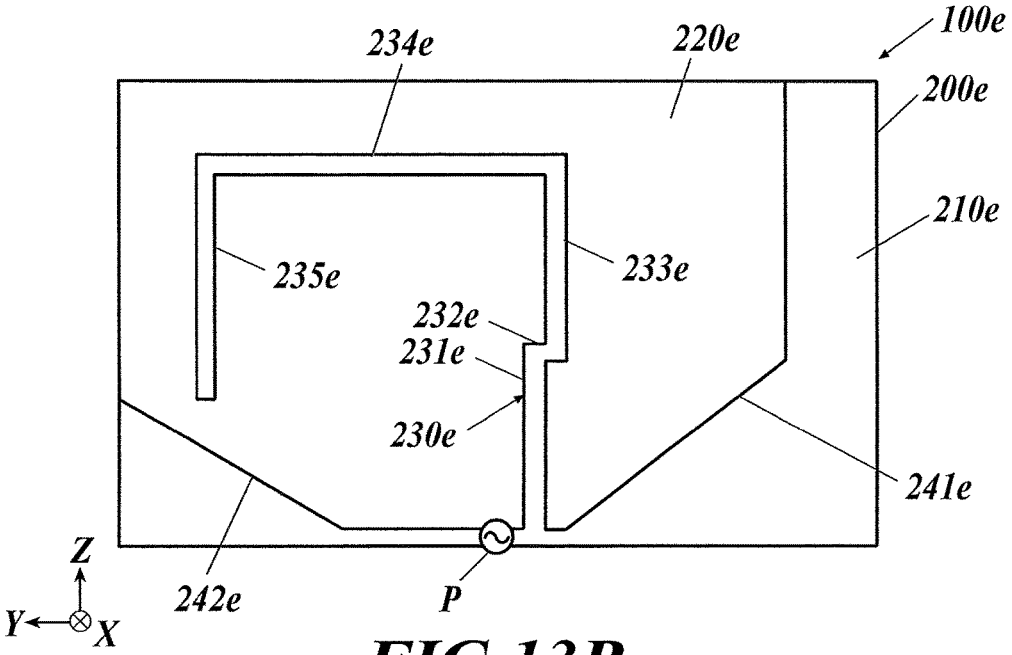
FIG. 13A is a plan view of a fifth planar antenna.
Figure 13B:
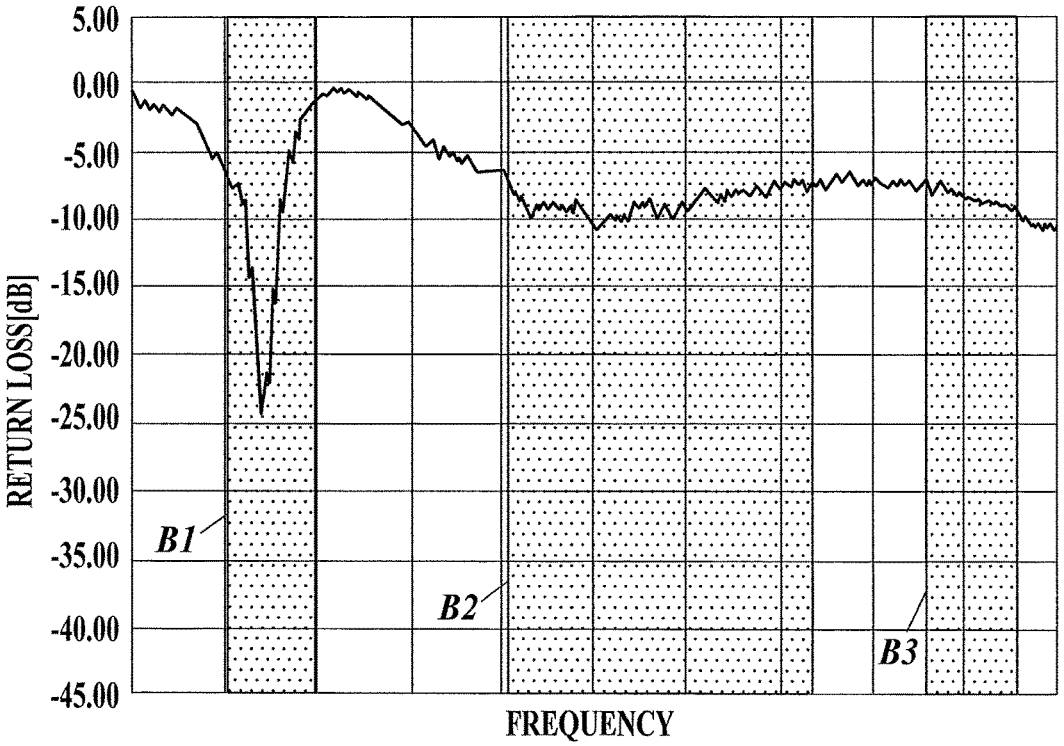
FIG. 13B illustrates the return loss of the fifth planar antenna with respect to frequency.

Next, a planar antenna 100*e* of a second variation will be described referring to FIG. 13A and FIG. 13B. FIG. 13A is a plan view of the planar antenna 100*e*. FIG. 13B illustrates the return loss of the planar antenna 100*e* with respect to frequency.

As illustrated in FIG. 13A, the planar antenna 100*e* includes a planar antenna portion 200*e*. The planar antenna portion 200*e* is configured such that a conductive body 220*e* is formed on one face of an antenna base board 210*e*. The antenna base board 210*e* and the conductive body 220*e* are made of the same materials as those of the antenna base board 210*a* and the conductive body 220*a* of the embodiment.

The conductive body 220*e* includes a slit 230*e* and tapered portions 241*e*, 242*e*. On the lower end (lower side) of the conductive body 220*e*, a feeding point P is provided. The slit 230*e* is composed of straight slit portions 231*e*, 232*e*, 233*e*, 234*e* and 235*e*.

The straight slit portion 231*e* has the shape of a straight strip and extends in the +Z direction from an open end near the right side of the feeding point P. The straight slit portion 232*e* has the shape of a straight strip and extends in the −Y direction from the end of the straight slit portion 231*e*. The straight slit portion 233*e* has the shape of a straight strip and extends in the +Z direction from the end of the straight slit portion 232*e*. The straight slit portions 231*e*, 232*e*, 233*e* correspond to a single slit portion that is bent 90 degrees twice. The straight slit portion 234*e* has the shape of a straight strip and extends in the +Y direction from the end of the straight slit portion 233*e*. The straight slit portion 235*e* has the shape of a straight strip and extends in the −Z direction from the end of the straight slit portion 234*e*.

That is, the slit 230*e* has the same shape as the slit 230*d* of the first variation except that the portion corresponding to the straight slit portion 232*d* is reduced in length. For example, this allows the larger angle of the tapered portion 241*e* with respect to the Y axis compared to the angle of the tapered portion 242*e* with respect to the Y axis. With regard to the return loss of the planar antenna 100*e* with respect to frequency, the measurement result as shown in FIG. 13B was obtained in the frequency range including the frequency bands B1, B2, B3. In FIG. 13B, the antenna exhibited good resonated return loss in the frequency band B1 and also good return loss of −5 dB or less in the frequency bands B2, B3.

In the second variation, the slit portion (straight slit portions 231*e*, 232*e*, 233*e*) extending from the open end is bent clockwise or anticlockwise to 90 degrees each. This configuration also enables expanding the band characteristics and reducing the size of the planar antenna 100*e*.

Figure 14A:
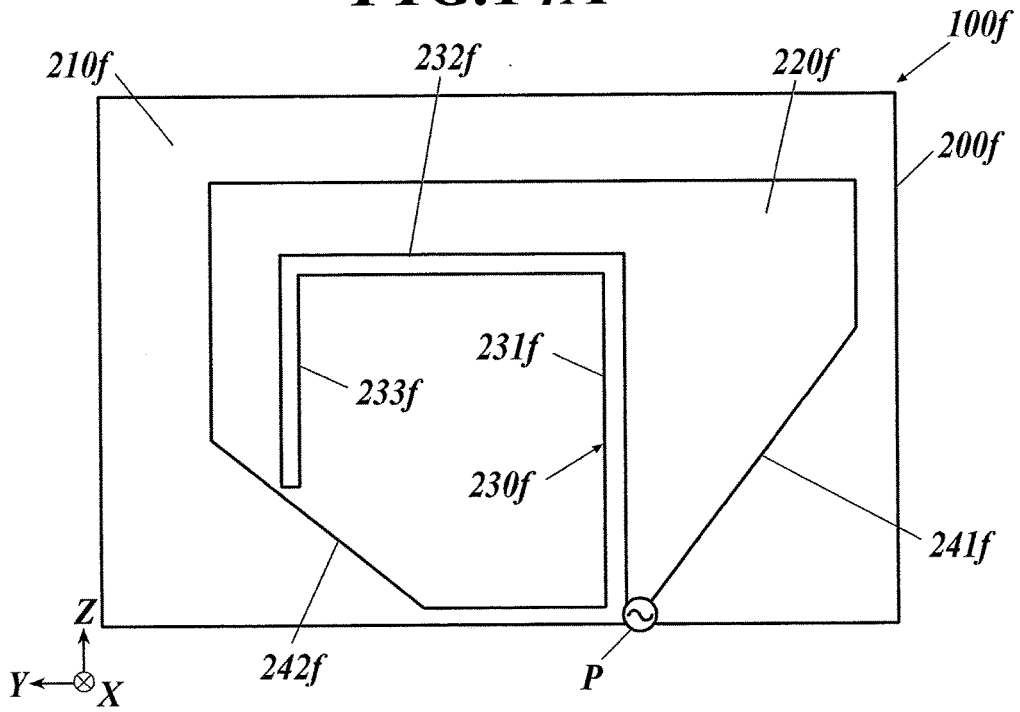
FIG. 14A is a plan view of a sixth planar antenna.
Figure 14B:
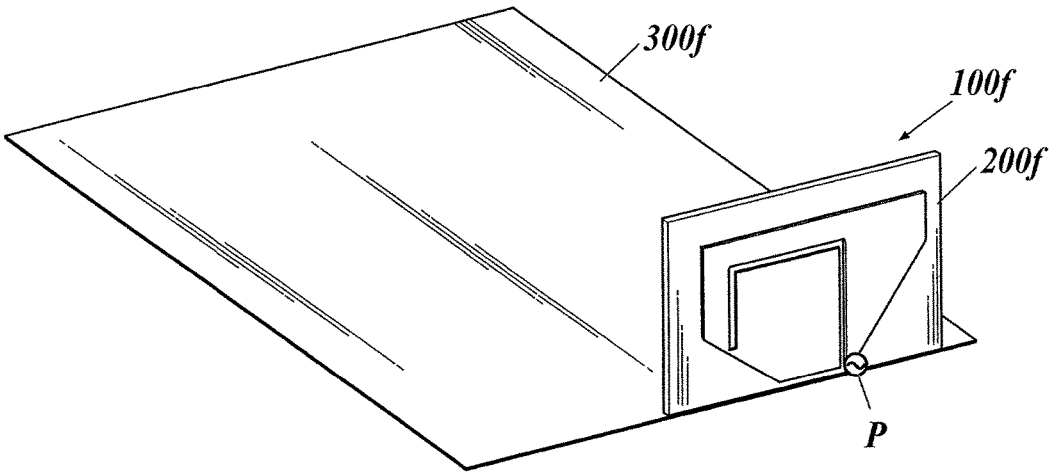
FIG. 14B is a perspective view of the sixth planar antenna.
Figure 14C:
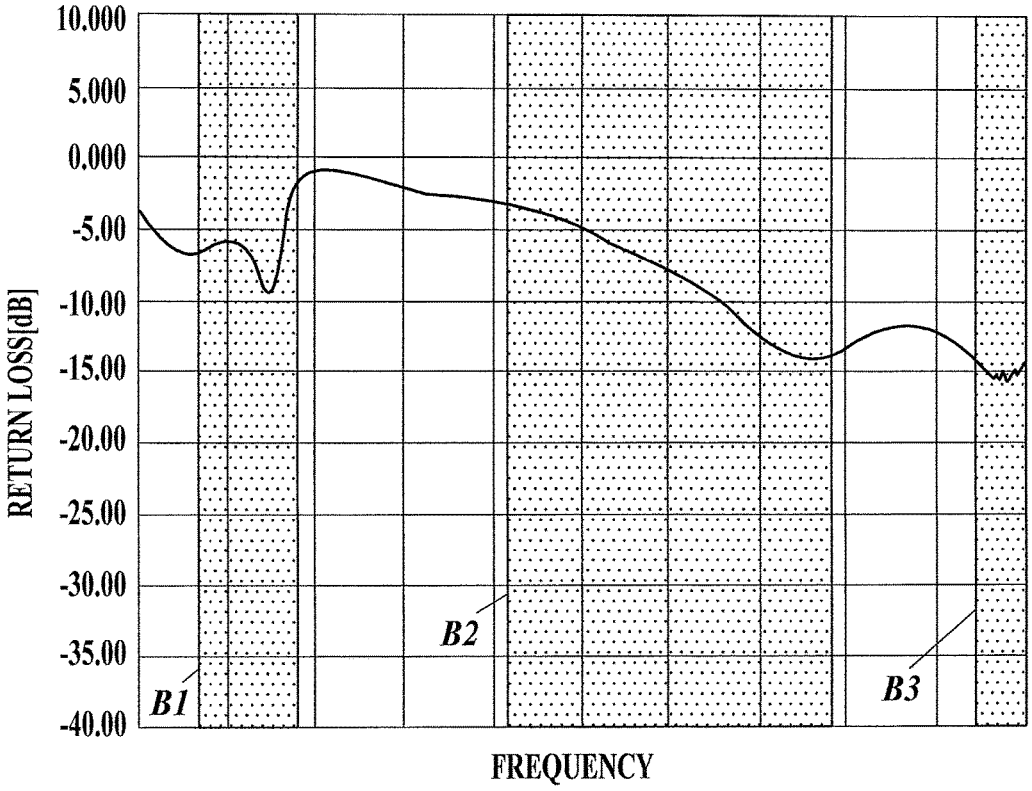
FIG. 14C illustrates the return loss of the sixth planar antenna with respect to frequency.

Next, a planar antenna 100*f* of a third variation will be described referring to FIG. 14A, FIG. 14B and FIG. 14C. FIG. 14A is a plan view of the planar antenna 100*f*. FIG. 14B is a perspective view of the planar antenna 100*f*. FIG. 14C illustrates the return loss of the planar antenna 100*f* with respect to frequency.

As illustrated in FIG. 14A, the planar antenna 100*f* includes a planar antenna portion 200*f*. The planar antenna portion 200*f* is configured such that a conductive body 220*f* is formed on one face of an antenna base board 210*f*. The antenna base board 210*f* and the conductive body 220*f* are made of the same materials as those of the antenna base board 210*a* and the conductive body 220*a* of the embodiment.

The conductive body 220*f* includes a slit 230*f* and tapered portions 241*f*, 242*f*. On the lower end (lower side) of the conductive body 220*f*, a feeding point P is provided. The slit 230*f* is composed of straight slit portions 231*f*, 232*f* and 233*f*.

The straight slit portion 231*f* has the shape of a straight strip and extends in the +Z direction from an open end near the left side of the feeding point P. The straight slit portion 232*f* has the shape of a straight strip and extends in the +Y direction from the end of the straight slit portion 231*f*. The straight slit portion 233*f* has the shape of a straight strip and extends in the −Z direction from the end of the straight slit portion 232*f*.

That is, the slit 230*f* has the same shape as the slit 230*a* of the above-described embodiment except that the position relative to the feeding point P is changed. For example, this allows the larger angle of the tapered portion 241*f* with respect to Y axis compared to the angle of the tapered portion 242*f* with respect to Y axis.

As illustrated in FIG. 14B, the planar antenna portion 200*f* was disposed at an end of a grounded portion 300*f* with the same size as the base board 60 in a standing manner, and the return loss of the planar antenna 100*f* was measured with respect to frequency. Regarding the return loss of the planar antenna 100*f* with respect to frequency, the measurement result as shown in FIG. 14C was obtained in the frequency range including the frequency bands B1, B2, B3. In FIG. 14C, the antenna exhibited good return loss of approximately −5 dB or less in the frequency bands B1, B2 and also good return loss of −5 dB or less in the frequency band B3.

Figure 15:
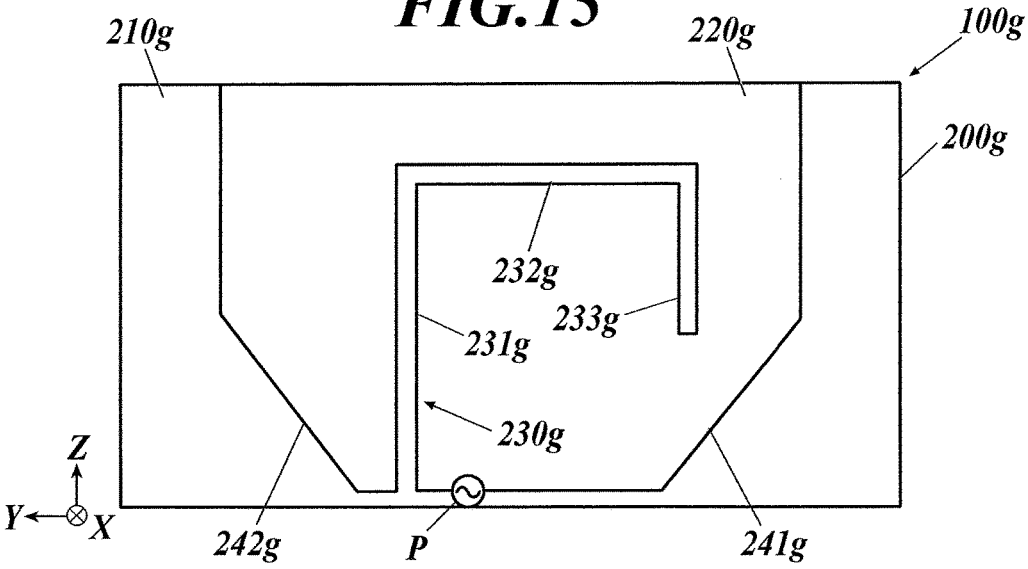
FIG. 15 is a plan view of a seventh planar antenna.

Next, a planar antenna 100*g* of a fourth variation will be described referring to FIG. 15. FIG. 15 is a plan view of the planar antenna 100*g*.

As illustrated in FIG. 15, the planar antenna 100*g* includes a planar antenna portion 200*g*. The planar antenna portion 200*g* is configured such that a conductive body 220*g* is formed on one face of an antenna base board 210*g*. The antenna base board 210*g* and the conductive body 220*g* are made of the same materials as those of the antenna base board 210*a* and the conductive body 220*a* of the embodiment.

The conductive body 220*g* includes a slit 230*g* and tapered portions 241*g*, 242*g*. On the lower end (lower side) of the conductive body 220*g*, a feeding point P is provided. The slit 230*g* is composed of straight slit portions 231*g*, 232*g* and 233*g*.

The straight slit portion 231*g* has the shape of a straight strip and extends in the +Z direction from an open end near the left side of the feeding point P. The straight slit portion 232*g* has the shape of a straight strip and extends in the −Y direction from the end of the straight slit portion 231*g*. The straight slit portion 233*g* has the shape of a straight strip and extends in the −Z direction from the end of the straight slit portion 232*g*.

That is, the slit 230*g* has the shape of the slit 230*a* of the above-described embodiment that is inverted in the Y direction. It may have the shape like the planar antenna 100*g*. For example, this allows the larger angle of the tapered portion 242*g* with respect to Y axis compared to the angle of the tapered portion 241*g* with respect to Y axis.

While the invention made by the present inventors is specifically described based on an embodiment and variations, the present invention is not limited to the above-described embodiment, and suitable changes can be made without departing from the features of the present invention.

For example, the above-described embodiment and variations are examples in which the conductive body of the planar antenna portion is constituted by copper foil. However, the present invention is not limited thereto. The conductive body may be constituted by other conductive materials such as copper tape and brass.

For example, the above-described embodiment and variations are examples in which the base body of the planar antenna portion, on which the conductive body is formed, is constituted by the antenna base board 210*a*, 210*d*, 210*e*, 210*f*, or 210*g* of a plastic carrier such as FR4 material. However, the material is not limited thereto. The base body may be made of other materials such as FPCs (flexible printed circuits) of polyimide or the like. The conductive body may be printed on such base bodies, and this configuration also allows planar antennas that can be produced easily at low cost and that can be readily integrated into an internal system.

The embodiment disclosed herein is exemplary in any way and is therefore not to be construed as limiting. The scope of the present invention is not defined by the above description but by the appended claims, and it is therefore intended that the invention be interpreted as including all such changes within the scope of the present invention along with the full scope of equivalents.

What is claimed is:

1. An antenna device, comprising:
- a flat base body; and
- a flat conductive body which is disposed on the base body and which has a polygonal shape;
- wherein the conductive body comprises:
  - an upper side and a lower side which extend horizontally, the lower side being opposed to a ground and being shorter than the upper side;
  - a right side and a left side which extend vertically downward from right and left ends of the upper side;
  - a right side tapered portion which extends diagonally between a lower end of the right side and a right end of the lower side;
  - a left tapered portion which extends diagonally between a lower end of the left side and a left end of the lower side;
  - a feeding point on the lower side; and
  - a slit which comprises an open end on the lower side in a vicinity of the feeding point, and
- wherein the slit comprises:
  - a first slit portion which extends from the open end;
  - a second slit portion which extends from an end of the first slit portion such that the second slit portion is turned to a perpendicular direction with respect to the first slit portion; and
  - a third slit portion which extends from an end of the second slit portion such that the third slit portion is turned to a perpendicular direction with respect to the second slit portion.

2. The antenna device according to claim 1, wherein a distance between the feeding point and the open end of the slit is 2.0 mm.

3. The antenna device according to claim 1, wherein the length of an outer periphery of the conductive body and an inner periphery of the slit is set to ¼ of a wavelength of a lowest operable frequency.

4. The antenna device according to claim 1, wherein the first slit portion is bent 90 degrees each in two different directions.

5. The antenna device according to claim 1, further comprising:
- an antenna cover having a shape of a shark fin;
- an antenna base connected to the antenna cover; and
- a base board which is disposed on the antenna base and which comprises a grounded portion,
- wherein the base body and the conductive body are mounted on the base board.

6. The antenna device according to claim 1, further comprising:
- a case of a communication unit; and
- a base board which is disposed in the case and comprises a grounded portion,
- wherein the base body and the conductive body are mounted on the base board.

7. The antenna device according to claim 6, wherein the base body and the conductive body are folded according to an inner shape of the case.

* * * * *